US005150638A

United States Patent [19]

Penisson

[11] Patent Number: 5,150,638

[45] Date of Patent: Sep. 29, 1992

[54] POWER TONG FOR MAKING UP OR BREAKING OUT THREADED JOINTS OF PIPE

[75] Inventor: Dennis J. Penisson, Raceland, La.

[73] Assignee: Bilco Tools, Inc., Houma, La.

[21] Appl. No.: 830,683

[22] Filed: Feb. 4, 1992

[51] Int. Cl.[5] ..... B25B 21/00

[52] U.S. Cl. ..... 81/57.17; 81/57.2

[58] Field of Search ..... 81/57.14–57.17, 81/57.19, 57.2, 57.33, 57.34, 57.35

[56] References Cited

U.S. PATENT DOCUMENTS

| | | | |
|---|---|---|---|
| 4,604,922 | 8/1986 | Soutsos | 81/57.17 |
| 4,694,712 | 9/1987 | Doss | 81/57.17 |
| 4,712,284 | 12/1987 | Coyle, Sr. et al. | 29/240 |
| 4,718,314 | 1/1988 | Coyle, Sr. et al. | 81/57.33 |

*Primary Examiner*—D. S. Meislin
*Attorney, Agent, or Firm*—Vaden, Eickenroht, Thompson, Boulware & Feather

[57] ABSTRACT

There are disclosed several embodiments of a power tong for making up or breaking out threaded joints of pipe wherein a head is rotatably mounted on a housing which is held against rotation and both the head and housing have slots adapted to be aligned to permit the tong to be moved onto or removed from a pipe joint. One or more belts are mounted on the head for movement into and out of positions gripping a substantial length of the circumference of the pipe in order to rotate the pipe with the head. The belt or belts are so moved by a hydraulic cylinder which permits the amount of gripping force to be adjusted.

10 Claims, 4 Drawing Sheets

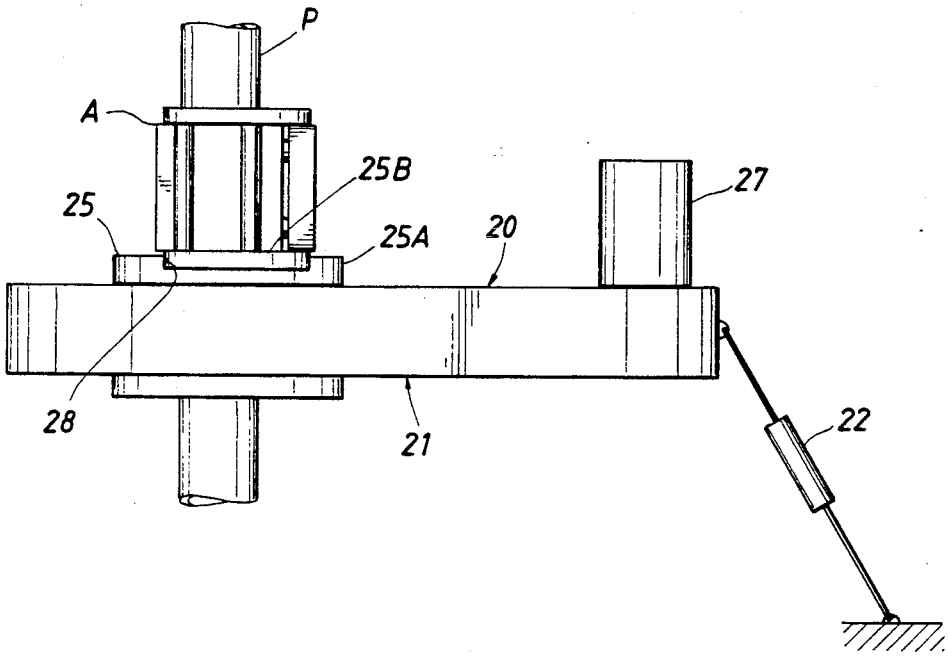
FIG. 1
FIG. 2
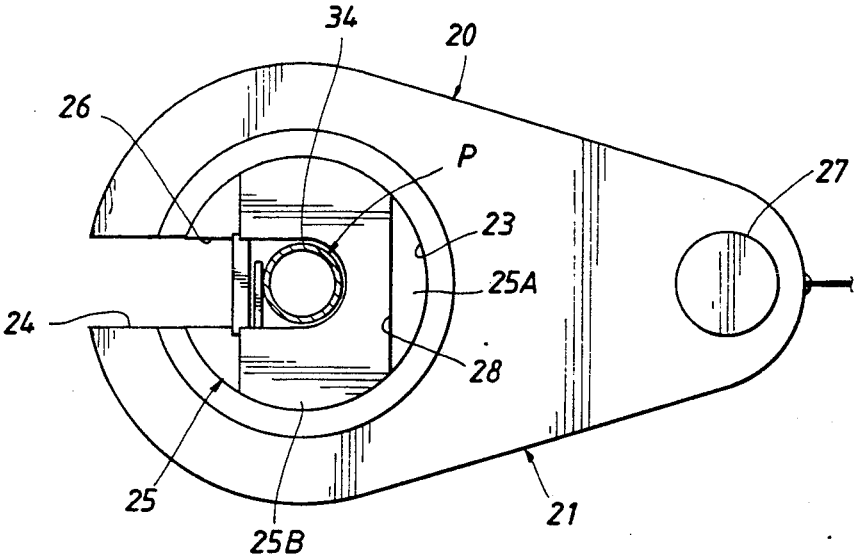

FIG.5
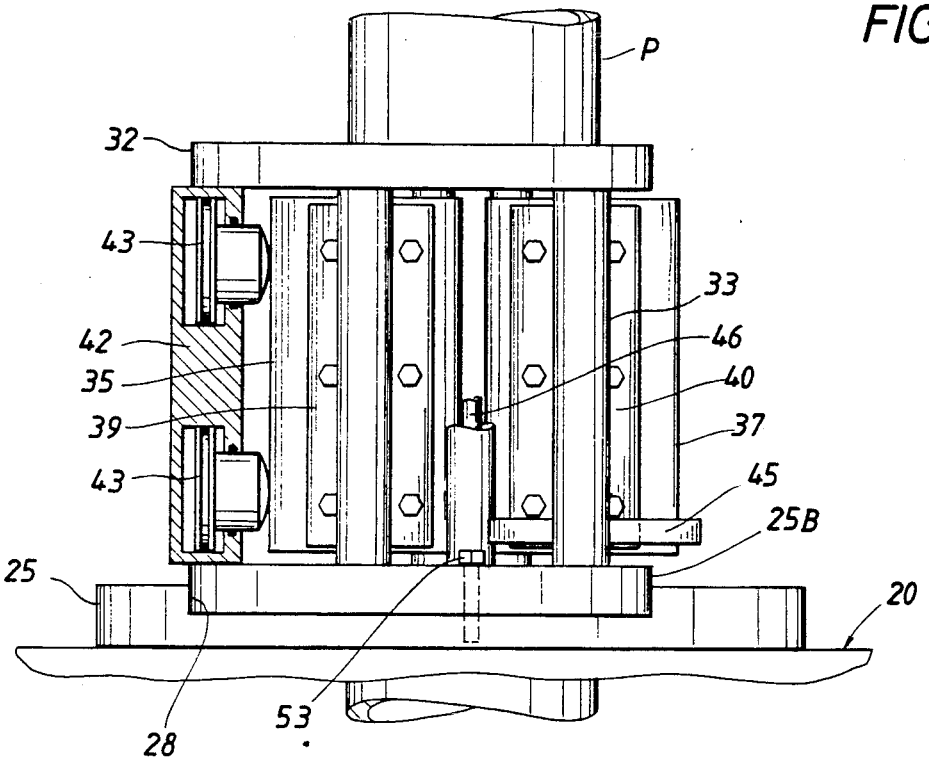
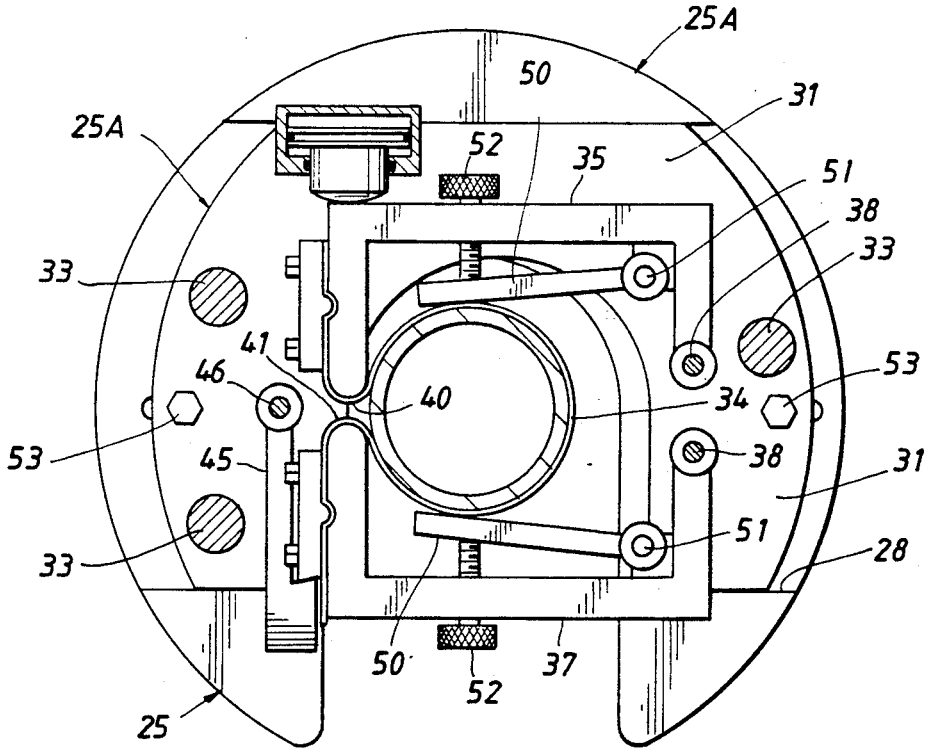
FIG.6

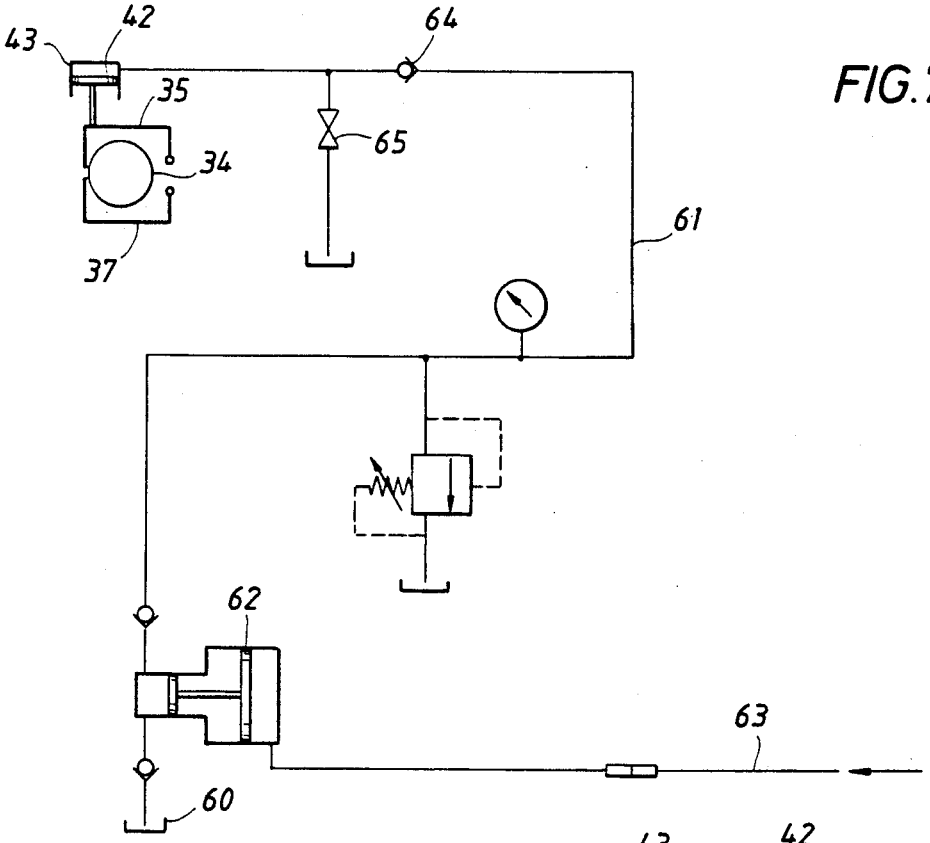
FIG.7
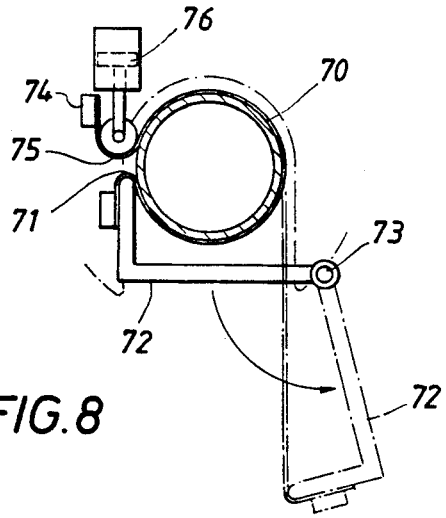
FIG.8
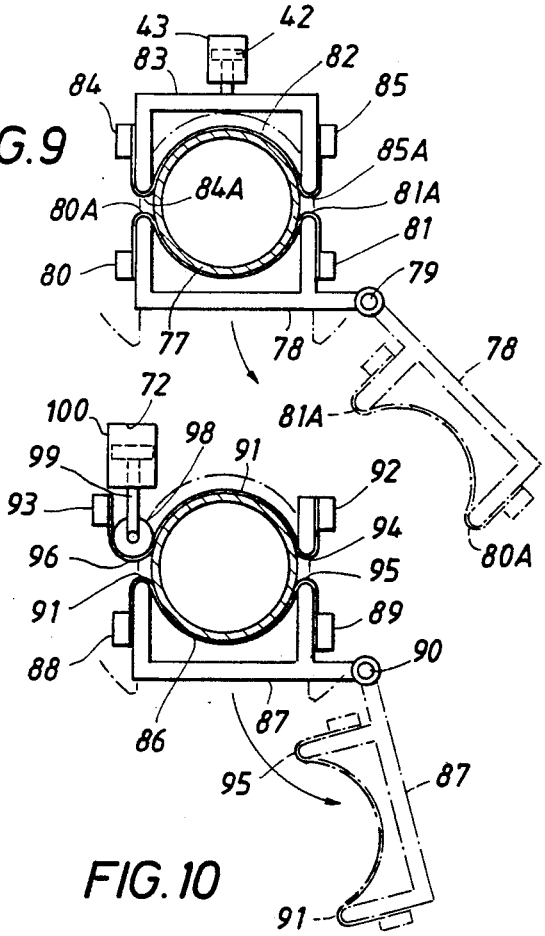
FIG.9
FIG.10

POWER TONG FOR MAKING UP OR BREAKING OUT THREADED JOINTS OF PIPE

This invention relates generally to power tongs for making up or breaking out threaded joints of pipe wherein one joint is gripped by means on a head rotatable within the housing or body of the tong independently of the torque by which the head itself is rotated. More particularly, it relates to improvements in power tongs of this type in which the pipe is gripped about a major portion of its circumferential surface so as to distribute the gripping force over a large area of the pipe.

As well known in the art, a power tong for making up or breaking out threaded joints of pipe, such as well pipe, conventionally comprises a body or housing which is held against rotation and a head which is mounted for rotation with respect to the body by a suitable motor, each of the body and head having slots which, when aligned, permit them to be moved over the pipe into or out of a position in which the axis of rotation of the head is aligned with pipe. More particularly, conventional tongs of this type include jaws which are carried on the head in position to be swung inwardly against the pipe by cams on the housing as the head is rotated with respect to the housing. As a result, the jaws are forced against the pipe with a force proportional to the torque for rotating the head.

U.S. Pat. No. 4,712,284 discloses an improvement upon these more conventional power tongs in that jaws carried by the head for gripping the pipe are moved against the pipe by means which is independent of the power source which rotates the head, and thus with a force independent of the torque applied to the head for rotating it with respect to the body. This may be particularly useful, for example, where the nature of the joint is such that it must be gripped with a lessor force to avoid damaging it, as, for example, in the case of plastic pipe or metal pipe with an outer plastic coating. More particularly, the jaws of the tongs shown in that patent are formed on the inner ends of pistons which are mounted on the head for movement into pipe gripping positions by fluid under pressure which is supplied to the pistons from a suitable source.

Although these jaws are thus capable of gripping the pipe with less force that applied by more conventional tongs, the gripping force is nevertheless confined to a relatively small area of the pipe thus causing each jaw to exert a relatively high unit pressure on the pipe surface it engages. The tongs of U.S. Pat. No. 4,718,314, also assigned to the assignee of the present application, overcame many of these problems by not only applying the gripping force independently of the force employed to rotate the head but also distributing that force over a large area.

Thus, as shown in the latter patent, a band in the form of a chain is anchored at one end to the head adjacent the end of the slot in the head to permit it to be wrapped about a major portion of the pipe and its other end then latched to the head near its one end. For this purpose, a crank arm is pivotally mounted on the head in position to engage and swing a pin on the outer side of the other end of the chain and move it in a direction essential tangentially of the pipe and thus tighten the chain about the pipe. In order to remove the tong from the pipe, the arm is swung in the opposite direction to release the pin so that the chain may be moved to one side of the slot in the head.

However, the above described tongs are difficult and expensive to manufacture, especially with a chain width sufficient to transmit the desired tongue to the pipe. Thus, the relatively small areas of the links of the chain which actually grip the pipe make it necessary to use a relatively wide chain. Furthermore, the means by which the chain is latched about the pipe does not permit the gripping force on the pipe to be adjusted.

The object of this invention is to provide power tongs which are adapted to overcome one or more of these problems.

Thus, one object is to provide such tongs for gripping a major portion of the circumference of the pipe, but which is less complex and less expensive to manufacture than that above described.

Another object is to provide such power tongs which are capable of being used with different sizes of pipe and in which the force by which the pipe is gripped is easily adjustable.

These and other objects are accomplished, in accordance with the illustrated embodiments of the invention, by a power tong of the type above-described which comprises a housing adapted to be held against rotation, and a head rotatably mounted on the housing, with each of the housing in head having slots adapted to be aligned with one another to receive a joint of the pipe along the axis of rotation to the head. However, in accordance with the novel aspects of the present invention, a major circumferential portion of the pipe joint is adapted to be engaged by flexible band means having a first portion near one end thereof which is mounted on an arm on the head for swinging between a first position adjacent to the side of the pipe joint and a second position to one side of the slot in the head. More particularly a means is provided for locking the arm in its first position, and fluid operated means is mounted on the head for moving a second portion of the band means near the other end thereof in a direction tangentially of the one side of the pipe joint and toward the first portion of the band means so that the pipe joint is tightly gripped by the band means for rotation with the head.

Thus, as will be appreciated, the pipe may be gripped by the band means with a force which may be adjusted as desired. Also, in order to mount the tongs on or remove them from the pipe, it is merely necessary to relieve the pressure on the fluid operated means and unlock and swing the arm to its second position to one side of the slot in the head. Still further, the band means automatically adjusts to a limited range of different pipe sizes since the second portion is moved in a tangential direction by the fluid operated means. Still further, the tong is simple and inexpensive to construct and to use.

In the preferred and illustrated embodiments of the invention, the band means comprises belt means made of flexible belting material which, for any given width, provides substantially more gripping surface of the pipe, thus reducing the overall height of the tongs and providing a more uniformed surface contact with the pipe joint. Still further, the use of belting material rather than a chain, as well as a simple arrangement for locking the arm with the first portion of the belt in its position adjacent to one side of the pipe, makes the tongs considerably less expensive to build and easier to operate.

In accordance with the preferred and illustrated embodiments of the invention, the band means comprises a continuous band or belt from one end or the other. In one such embodiment, the power tong includes another arm which pivotally mounts the second portion of the belt for swinging toward the one side of the pipe and into a position in which the arm may be engaged by the fluid operated means to in turn force the second portion of the band in the tangential direction. Preferably, a means is also carried by the arms for movement inwardly to engage the belt on opposite sides of the pipe and thus limit movement of the pipe in a direction lengthwise of the slot.

In the preferred embodiment of the invention, the head of the power tongs comprises a base rotatedly mounted on the housing and having a guideway extending latterly of the slot, a carrier for the arms and the fluid operated moving means which is mounted in the guideway for sliding there across, and means by which the carrier may be fixedly located in different positions longitudinally of the guideway and thus latterly of the slot. In this manner, the head may be adjusted to maintain the axis of pipes of different diameters aligned with the axis of the rotation of the head. In an alternative embodiment of the invention, a means is provided on the head for locking the other end of the arm in a fixed position to dispose the outer side of the band opposite the second portion thereof and thus in position to be engaged by the fluid operating means.

In still further alternative embodiments in the invention, the band means comprises a first continuous band, preferably a belt, having the first portion near one end thereof as well as another portion near its other end supported by the arm to form a curved surface adapted to fit closely about a pipe portion of the pipe, and a second continuous band, also preferably a belt, having the second portion near one end thereof as well as another portion near its other end mounted on the head to form a curved surface adapted to fit closely about the opposite portion of the pipe. In one such alternative embodiment, the other end of the second band is fixedly mounted on the head, and the fluid operated means is arranged to engage the outer side of the second band. In still another such alternative embodiment, the ends of the second band are supported on a frame mounted on the head for movement toward and away from the first belt, and the fluid operated means is arranged to so move the frame.

In the drawings, where unlike reference characters are used throughout the designate like parts:

FIG. 1 is a side elevational view of power tongs constructed in accordance with the present invention, and showing a pipe joint arranged within the head rotatably mounted on the housing;

FIG. 2 is a top plan view of the power tongs shown in FIG. 1;

FIG. 5 is a side view of the head, as seen in FIG. 3, and with a portion thereof shown in section;

FIG. 6 is a view of the head similar to FIG. 3, but with the plate on which the belt is mounted shifted in a guideway across the base of the head to enable the belt to grip a pipe joint of smaller diameter;

FIG. 7 is a diagrammatic view of a hydraulic system for operating the power operated means of the tongs of 1 to 6;

FIG. 8 is a reduced, horizontal sectional view of a portion of the head of an alternative embodiment of the tongs, wherein the belt is shown in solid lines as it grips the pipe and in broken lines upon removal therefrom;

Figure 3:
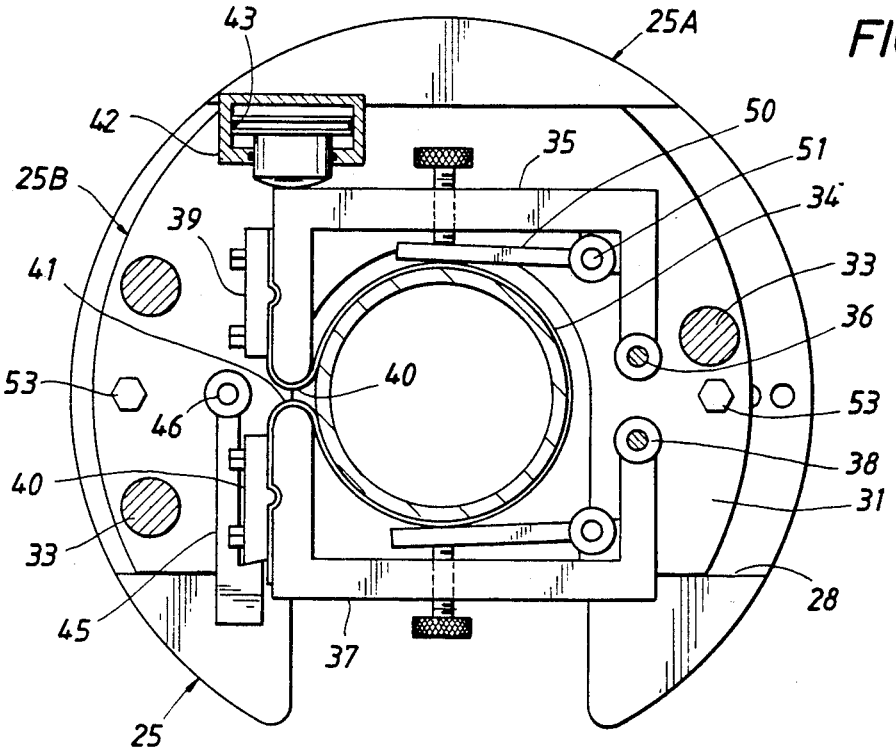
FIG. 3 is an enlarged horizontal sectional view of the head removed from the housing of the tongs of FIG. 1 and 2, and showing the pipe gripped by a belt mounted on the head for rotation therewith.

FIG. 9 is a horizontal sectional view of a portion of the head of another alternative embodiment of the invention wherein the pipe is adapted to be gripped by two belts as shown in solid lines and to be removed from the head upon movement of one belt away therefrom, as shown in broken lines; and FIG. 10 is a still further horizontal cross sectional view of a portion of the head of a still further alternative embodiment of the invention, similar to that of FIG. 9, but showing a different arrangement of the fluid operated means for tightening one belt about an upper portion of the pipe.

With reference now to the details to the above described drawings, the overall power tongs, which is indicated in its entirety in FIGS. 1 and 2 by reference character 20, comprises a housing or body 21 which is connected at one end to a load cell 22 anchored to a fixed point and which has an opening of 23 near its other end and a slot 24 connecting the opening with the other end of the housing. More particularly, a head 25 is mounted for rotation within the opening 23 and also has a slot 26 formed therein which is adapted to be aligned with the slot 24 in the housing in one rotative position of the head, as shown in FIG. 2. In a manner well known in the art, the head is rotated within the housing by means of a motor 27 mounted at the one end of the housing and suitably connected to the head for imparting rotation thereto. The load cell 22 will, of course, prevent the housing from rotating due to the reactive force of the rotating head on the pipe.

As shown in FIGS. 1 and 2, a pipe joint P is disposed within the head with its axis aligned with the axis of rotation of the head such that, when gripped by means on the head in a manner to be described, the pipe may be rotated with the head. As shown in FIG. 2, with the slots in the housing and head aligned, the tongs may be moved onto or removed from the pipe when the pipe gripping means to be described have been moved to one side of the slots, as will also be described.

As previously described, and as shown diagrammatically in FIGS. and 2, the head 25 comprises a base 25A connected by suitable means to the motor 27 for rotation within the housing opening 23, and a carrier 25B which is mounted on the base and shiftable laterally thereof within a guideway 28 formed transversely of the slot.

As also previously described, the means for gripping and releasing the pipe is mounted on the carrier of the head for movement with it longitudinally of the guideway 28 in the base. Thus, the carrier includes a bottom wall 31 which is slideably supported in the guideway 28, and a top wall 32 which is mounted above the bottom wall 31 by means of columns 33 extending between them.

In the embodiment of the head shown in FIGS. 3–6, a continuous belt 34 is connected at one end to an arm 35 slingably mounted on the carrier by means of a hinge pin 36 extending between its upper and lower walls, and connected at its opposite ends to a another arm 37 swingably mounted on the head by means of a hinge pin 38 extending between the top and bottom walls of the carrier. Each of the arms 35 and 37 is essentially U-shaped, with the arm 35 normally disposed across the closed end of the slot in the head, and the arm 37 swingable between the position of FIG. 3 across the open end of the slot, so as to wrap the belt about the pipe, and the position of FIG. 4, to move the one end of the belt to one side of the slot and thus remove the belt from the slot from the pipe so that the tong may be moved onto of off of the pipe.

The one end of the belt is fixed to the left hand side of the arm 35 by means of a releasable clamp 39 to dispose a portion 40 of the belt near such one end on the left side of the pipe. The other end of the belt is releasably connected to the left side of the arm 37 by similar releasable clamp 40 so as to dispose a portion 41 of the belt near its other end in a position opposite and near to the portion 40 on the left side of the pipe when the belt is wrapped about the pipe as in FIG. 3.

Fluid operated means in the form of one or more pistons 42 reciprocal within cylinders 43 formed within vertical posts extending between the top and bottom walls of the carrier head are arranged to exert force on the outer ends of the arm 35 in a direction generally tangentially of the left side of the pipe, and thus in a direction toward the portion 41 of the belt when the arm 35 is moved to the position of FIG. 3. Fluid may be supplied to or exhausted from the cylinders on the rear sides of the pistons in a manner to be described more fully hereinafter.

Figure 4:
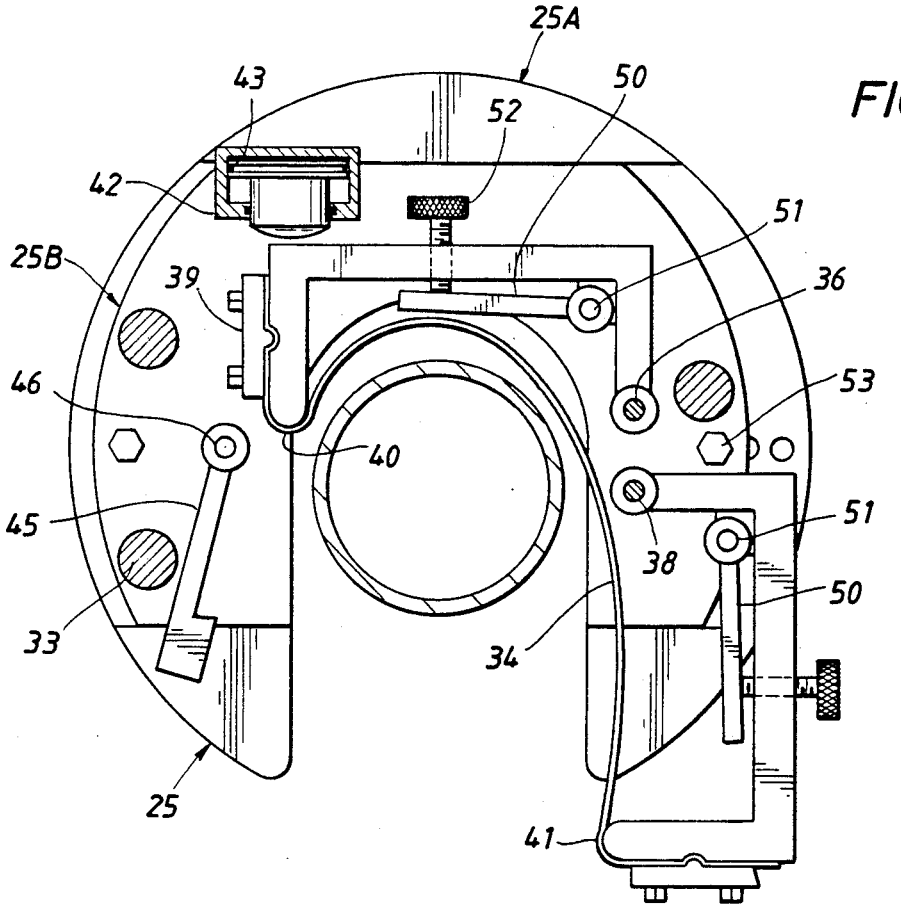
FIG. 4 is a view similar to FIG. 3 but in which the belt has been moved away from the pipe to permit the tong to be moved off of the pipe.

With the pistons retracted, the arm 37 swung to a position to one side of the slot, and a locking means in the form of a latch 45 swingably connected to the head by means of a hinge pin 46 extending between the top and bottom walls of the carrier moved outwardly to unlatching position, as shown in FIG. 4, the tong may be moved onto or off of the pipe P received coaxially of the head.

Assuming that the tong has just moved onto the pipe, and it is desired to wrap the belt about the pipe, the arm 37 is swung in a clockwise direction from the position of FIG. 4 to the position of FIG. 3, and the latch 45 is moved counterclockwise to move the finger on its outer end beneath the lower end of the clamping means 40. At this time, fluid pressure may be applied to the back sides of the pistons 42 so as to move them downwardly against the upper side of the arm 35 and thus force the portion 40 tangentially toward the portion 41 of the belt. This tightens the belt about the pipe as it forces the clamp downwardly against the finger of the latch 45 to hold the locking means in place. As previously described, the use of fluid pressure for this purpose permits the belt to grip the pipe with any desired degree of pressure.

Conversely, when it is desired to remove the tong from the pipe, it is merely necessary to retract the pistons 42 to permit the latch 45 to be swung out of locking position, and thus permit the arm 37 to be swung in a counterclockwise direction to one side of the slot in the head as shown in FIG. 4. Vertically extending plates 50 are swingably mounted on the arms by means of hinge pins 51 to dispose the inner sides of the plates opposite the portions of the belt of the upper and lower sides of the pipe generally intermediate the sides of the slot in the head when both arms in the position of FIG. 3. Each of these arms may be moved inwardly by means of a screw 52 mounted on the arm from which the plate is carried. Preferably, the screws are moved inwardly to move the inner sides of the plates into a position at least close to the outer surfaces the belt, thus limiting movement of the belt and pipe in a direction longitudinally of the slot, and thus maintaining the pipe coaxially of the rotatably head.

The carrier is held in a fixed position on the base of head by means of pins 53 received in holes in the base beneath the guideway. As indicated in FIGS. 3 and 4, there are a series of laterally spaced holes which permit the carrier to be mounted in different positions longitudinally of the guideway. Thus, for example, when the belt is to grip a smaller diameter pipe, as shown in FIG. 6, the carrier may be moved to the right and held in the adjusted position so as to bring the axis of the smaller pipe into alignment with the axis of rotation of the head.

As previously described, the above described apparatus permits the belt to be gripped about different sizes of pipe, at least within a limited range. For this purpose, it is also possible to adjust the positions of the portions 40 and 41 adjacent to the opposite ends of the belt by connection and reconnection of the clamping means 39 and 40.

As will be understood from the foregoing description, and as shown diagrammatically in FIG. 7, with the arms 35 and 37 moved to positions facing oppositely to one another, so as to dispose the belt 34 about a pipe, the belt may be tightened about the pipe by the supply of hydraulic fluid to the cylinder 43 on the outer side of the piston 42. As also shown in FIG. 7, hydraulic fluid from a suitable source 60 may be supplied to or exhausted from the cylinder 43 in order to respectively urge the piston 42 downwardly against the arm 35 or permit it to be withdrawn therefrom. For this purpose, the hydraulic fluid is adapted to be supplied to the cylinder through conduit 61 by means of a reciprocating pump 62 adapted to be operated in response to the supply of air to the operator thereof through a conduit 63. Hydraulic fluid is maintained within the cylinder to hold the piston in its extended position by means of a check valve 64 in the conduit 61 intermediate to the cylinder and the pump 62. When it is desired to relieve the pressure on the piston and thus permit it to retract, an exhaust valve 65 intermediate check valve 64 and the cylinder may be opened to drain the hydraulic fluid in the cylinder into the reservoir.

The embodiment of the head shown diagrammatically in FIG. 8 is similar to that above-described in that it includes a continuous belt 70 adapted to grip the pipe for rotation with the head. Also, a portion 71 of the belt near one end thereof is carried by an arm 72 swingably mounted on a hinge pin 73 on the carrier of the head for movement between the solid line position of FIG. 8 in which such portion 71 is adjacent one side of the pipe and the broken line position wherein the belt and arm are to one side of the slot in the head. As also shown in FIG. 8, the one end of the belt is releasably connected to the left side of the arm 72 by means of a releasable clamp.

This embodiment of the head differs from that previously described, however, in that the other end of the arm is releasable connected in a fixed position on the carrier by a clamp 74 to dispose another portion 75 of the belt near its other end opposite and close to the portion 71 when the arm is swung to its solid line position to dispose the belt about the lower side of the pipe. More particularly, the cylinder for the piston 76 of the fluid operating means is so disposed on the head that a roller on the end of the piston rod moves tangentially of the left side of the pipe and against the outer side of the portion 75 of the belt so as to move such portion toward the portion 71 on the arm 72. Also, the arm 72 may be releasably locked in the solid line position of FIG. 8, as in the manner shown and described in connection with the previous embodiment of the invention.

Still further, it will be understood that this alternative embodiment of the invention accomplishes the objects of the invention, as in the case of the first described embodiment, in that it permits the belt to grip different sizes of pipe as well as to grip the pipe with varying degrees of force. Hydraulic fluid may be supplied to or exhausted from the cylinder in the manner described above in connection with FIG. 7. This, of course, moves the portion 75 of the belt towards the portion 71, which has been moved into and locked in the solid line position of FIG. 8 by swinging in of the arm 72 in a clockwise direction. It will also be understood, as in the case of the embodiment of FIGS. 1–6, the cylinder as well as the swingable arm 72 and the clamp 74 may be mounted on a shiftable carrier of the head.

The embodiments of FIGS. 9 and 10 differ from those of FIGS. 1–6 and 8 in that the pipe is adapted to be gripped by a pair of belts each having an inner surface for disposal about substantially one-half of the pipe joint. Thus, in the FIG. 9 embodiment, a first belt 77 is mounted on an arm 78 for swinging about a hinge pin 79 mounted on the head between the solid line position in which the belt is disposed about substantially all the lower half of the pipe joint, and the broken line position to one side of the slot in the head. As shown, the ends of the belt 77 are releasably secured to the arm by means of clamps 80 and 81, similar to those described in the embodiment of FIGS. 1–6. Also, as is the case of the previous embodiments, the arm 78 may be locked in its solid line position. With the arm so locked, portions 80A and 81A near opposite ends of the belt are disposed adjacent opposite sides of the pipe.

The other belt 82, on the other hand, is mounted on a U-shaped frame 83 which faces oppositely to the U-shaped upper side of the arm 79 to dispose the belt 82 in position for engaging about the upper half of the pipe joint when the frame 83 is moved inwardly or downwardly with respect to the lower belt 78 carried on the arm 79 to dispose portion 84A close to and opposite portion 80A and the portion 85A close to and opposite portion 81A of the belt 82. More particularly, the frame 83 is mounted on the lower end of the piston 42 reciprocal within the cylinder 43 mounted on the head, as in the case of the prior described embodiments. Thus, the piston may be moved inwardly to cause the belts to grip the pipe with any desired degree of force. The ends of the belt 82 may be releasably mounted on the arms of the frame by means of clamps 84 and 85.

In the embodiment of FIG. 10, the belt 86 is mounted on the U-shaped end of an arm 87 for swinging therewith between the solid line position in which it engages substantially all of the lower half of the pipe joint to the broken line position in which it moves the belt to the side of the slot in the head. The ends of the belt 86 are fixedly mounted on the arm by means of clamps 88 and 89, and the arm swings on a hinge pin 90 mounted on the head.

The other belt 91 has one end fixedly mounted on the head by means of a releasable clamp 92 and another end fixedly mounted on the head by means of a further releasable clamp 93. The clamp 92 holds a portion 94 of the belt close to the side of the pipe joint opposite the portion 95 of the belt 86 held by the arm 87. The other end of the belt 91, on the other hand, is spaced to the left of the end of the belt 86 so as to provide a portion 96 which is opposite the portion 91 of the belt 86 on the arm 87.

This portion 96 may be moved toward the portion 97 so as to tighten the belt by means similar that are described in connection with the embodiment of FIG. 8. Thus, a roller 98 is mounted on the lower end of a piston 99 reciprocal within a cylinder 100 mounted on the head, whereby extension of the piston forces the roller against the outer side of the belt 91 and thus urges the portion 96 of the belt toward the portion 91 of the other belt 86. Thus, as in the case of the embodiment of FIG. 9, the hydraulic cylinder not only forces the belt 91 about the top side of the pipe, but also forces the lower side of the pipe about the lower belt 86, so as to thereby adjust the gripping force applied by the belts to the pipe.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed:

1. A power tong for making up or breaking out threaded joints of pipe, comprising a housing adapted to be held against rotation, a head rotatably mounted on the housing, each of the housing and head having slots adapted to be aligned with one another to receive a joint of the pipe along the axis of rotation of the head, flexible band means having a length adapted to surround a major circumferential portion of the pipe joint, an arm mounting a first portion of the band means on the head for swinging between a first position adjacent one side of the pipe joint and a second position to one side of the slot in the head, means for locking the arm in said first position, and fluid operated means on the head for moving a second portion of the band means in a direction tangentially of the one side of the pipe joint and toward said first portion of the band means so that the pipe joint is tightly gripped by the band means for rotation with the head.

2. As in 1, wherein the band means comprises a continuous band from one end to the other.

3. As in 2, including another arm pivotally mounting the second portion of the band for swinging toward the one side of the pipe and into a position in which said arm may be engaged by the fluid operated means to in turn force the second portion of the band in said tangential direction.

4. As in 3, including means carried by the arms for movement inwardly to positions close to opposite side of band and thus limit movement of the pipe in a direction lengthwise of the slot.

5. As in 4, wherein the head comprises a base rotatably mounted on the housing and having a guideway extending laterally of the slot, a carrier for said arms and said fluid operated moving means mounted in the guideway for sliding thereacross, and means by which the carrier may be fixedly located in different positions longitudinally of the guideway.

6. As in 2, including means for locking the end of the arm near the second portion of the band in a fixed position on the head to dispose the outer side of the band opposite the second portion thereof in position to be engaged by the fluid operated moving means.

7. As in 1, wherein the band means comprises a first continuous band having the first portion as well as another portion thereof supported by the arm to form a curved surface adapted to fit closely about a portion of the pipe, and a second continuous band having the second portion thereof as well as another portion mounted on the head to form a curved surface adapted to fit closely about an opposite portion of the pipe.

8. As in 7, wherein the end of the second band near the second portion thereof is fixedly mounted on the head, and the fluid operated means is arranged to engage the outer side of the second portion.

9. As in 7, wherein the band is carried on a frame mounted on the head for movement toward and away from the first belt, and the fluid operated means is arranged to so move the frame.

10. As in 1, wherein the band means comprises belt means.

* * * * *